US006611192B1

(12) United States Patent
Kamoshida et al.

(10) Patent No.: US 6,611,192 B1
(45) Date of Patent: Aug. 26, 2003

(54) VOLTAGE-NONLINEAR RESISTOR, METHOD FOR MAKING THE SAME, AND VARISTOR USING THE SAME

(75) Inventors: Yukihiro Kamoshida, Yokaichi (JP); Kazutaka Nakamura, Yasu-gun (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 45 days.

(21) Appl. No.: 09/708,155

(22) Filed: Nov. 8, 2000

(30) Foreign Application Priority Data

Nov. 12, 1999 (JP) ..... 11-322429

(51) Int. Cl.[7] ..... H01C 7/13
(52) U.S. Cl. ..... 338/20; 338/21
(58) Field of Search ..... 338/20, 21

(56) References Cited

U.S. PATENT DOCUMENTS 2,150,167 A * 3/1939 Hutchins et al. ..... 338/21
3,291,759 A * 12/1966 Pitha ..... 338/21
3,607,790 A * 9/1971 Pitha ..... 252/516
4,209,474 A * 6/1980 Prochazka ..... 264/29.5
4,569,921 A * 2/1986 Omori et al. ..... 501/88
5,976,420 A * 11/1999 Nakamura et al. ..... 252/516
6,157,290 A * 12/2000 Glatz-Reichenbach et al. .. 338/22 R

FOREIGN PATENT DOCUMENTS

JP 31-3077 3/1954
JP 3-265559 11/1991
JP 11-139868 5/1999

OTHER PUBLICATIONS

Japanese Office Action issued Jul. 23, 2002 (w/ English translation of relevant portion).
Copy of Japanese Examination Report dated Feb. 25, 2003 (and English translation of same.

* cited by examiner

*Primary Examiner*—Karl D. Easthom
(74) *Attorney, Agent, or Firm*—Dickstein, Shapiro, Morin & Oshinsky LLP

(57) ABSTRACT

A varistor includes a voltage-nonlinear resistor and varistor electrodes provided on the upper and lower surfaces of the voltage-nonlinear resistor. The voltage-nonlinear resistor is primarily composed of SiC (silicon carbide) particles which are doped with at least one dopant such as N (nitrogen) and P (phosphorus). The varistor electrodes are composed of a metal, e.g., Ag, Pd, Pt, Al, Ni or Cu. The SiC particles of the voltage-nonlinear resistor further contain at least one element of Al (aluminum) and B (boron) in an amount of about 0.01 to 100 parts by weight with respect to 100 parts by weight of the SiC particles.

17 Claims, 3 Drawing Sheets

VOLTAGE-NONLINEAR RESISTOR, METHOD FOR MAKING THE SAME, AND VARISTOR USING THE SAME

BACKGROUND OF THE INVENTION

1. Field of the Invention

The present invention relates to voltage-nonlinear resistors, the method for making the same, and varistors using the same.

2. Description of the Related Art

With miniaturization of circuits and shift of reference frequencies towards higher regions, miniaturized electronic components, which can work in higher frequencies, are required. Moreover, electronic components which can work in lower voltages are required, as the drive voltages of the circuits tend to decrease. Varistors as abnormal-voltage absorbing elements also must have such requirements.

SiC-based, ZnO-based and $SrTiO_3$-based voltage-nonlinear resistors for constituting varistors are known. ZnO-based and $SrTiO_3$-based voltage-nonlinear resistors are used in monolithic varistors having driving voltages of 3.5 V or more.

When varistors are used as noise-absorbing elements of signal circuits and the like in higher frequencies, the varistors must have reduced electrostatic capacitance. Moreover, the varistor voltage must be low in order to use them at a lower drive voltage.

Conventional ZnO-based varistors have apparent relative dielectric constants $\epsilon r$ of 200 or more. The apparent relative dielectric constants of $SrTiO_3$-based varistors are on the order of several thousands to several tens of thousands and are higher than that of the ZnO-based varistors. Thus, in order to reduce electrostatic capacitance in the varistor, the electrode area of the varistor must be significantly reduced or the thickness of the voltage-nonlinear resistor must be increased so as to increase the distance between the varistor electrodes. A reduced electrode area, however, causes a decreased surge current capacity, whereas a decreased varistor voltage causes increased electrostatic capacitance. Accordingly, it is difficult to simultaneously achieve a low voltage and low capacitance.

Since SiC-based varistors have low apparent relative dielectric constants $\in_r$, low electrostatic capacitance can be readily obtained. The SiC-based varistors, however, exhibit lower voltage-nonlinearity coefficients ($\alpha$) compared to other types of varistors. That is, the coefficients of the SiC-based varistors are at most 8, whereas the coefficients of the ZnO-based and $SrTiO_3$-based varistors are several tens.

SUMMARY OF THE INVENTION

Accordingly, it is an object of the present invention to provide a voltage-nonlinear resistor having small electrostatic capacitance, a high voltage-nonlinearity coefficient ox and a high varistor voltage, to provide a method for making the voltage-nonlinear resistor, and to provide a varistor using the voltage-nonlinear resistor.

According to an aspect of the present invention, a voltage-nonlinear resistor comprises SiC particles as a primary component, the SiC particles being doped with a dopant and containing at least one of elemental Al and B. Preferably, the at least one Al or B element is coordinated on the surfaces of the SiC particles doped with the dopant. Preferably, the surfaces of the SiC particles doped with the dopant are oxidized. The total content of Al and B is in a range of preferably about 0.01 parts by weight to 100 parts by weight and more preferably about 0.5 parts by weight to 50 parts by weight with respect to 100 parts by weight of the SiC particles doped with the dopant. Preferably, the dopant is at least one of elemental N and P. The total content of the dopant is preferably in a range of about 30 ppm to 10,000 ppm. The SiC doped with the dopant is thereby an n-type semiconductor. Preferably, the SiC has a $\beta$-type crystal system.

The resulting voltage-nonlinear resistor exhibits a low apparent relative dielectric constant $\in r$, a voltage-nonlineanity coefficient $\alpha$ and a low varistor voltage.

According to another aspect of the present invention, a method for making a voltage-nonlinear resistor comprises: mixing SiC doped with a dopant and at least one of Al and B to prepare a powdered mixture, heat-treating the powdered mixture in an oxidizing atmosphere to form a metal oxide crystal phase comprising at least one of $Al_2O_3$ and $Al_6Si_2O_{13}$ and a $SiO_2$ crystal phase. Preferably, the heat treatment is performed at a temperature of about 1,000° C. to 1,600° C. This method facilitates coordination of Al and B on the surfaces of the SiC particles and oxidation of the surfaces of the SiC particles.

According to another aspect of the present invention, a varistor comprises the above voltage-nonlinear resistor and varistor electrodes.

The varistors comprising the voltage-nonlinear resistor has superior varistor characteristics.

DESCRIPTION OF THE PREFERRED EMBODIMENTS

The embodiments of voltage-nonlinear resistor, the method for making the same, and the varistor using the voltage-nonlinear resistor will be described with reference to the attached drawings.

First Embodiment

Figure 1:
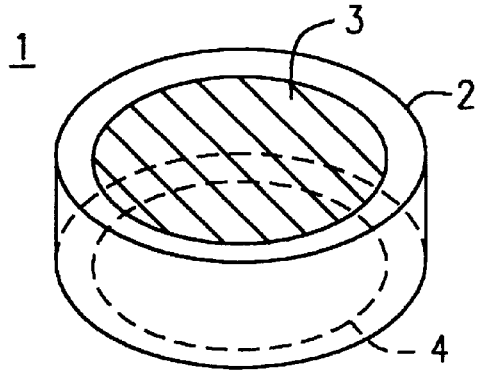
FIG. 1 is an isometric view of an embodiment of a varistor in accordance with the present invention.

With reference to FIG. 1, a varistor 1 consists of a voltage-nonlinear resistor 2 and varistor electrodes 3 and 4, which are provided on the upper and lower surfaces of the voltage-nonlinear resistor 2. The voltage-nonlinear resistor 2 is primarily composed of SiC (silicon carbide) particles which are doped with at least one dopant, such as N (nitrogen) and P (phosphorus), in an amount of approximately 500 ppm. The varistor electrodes 3 and 4 are composed of a metal, e.g., Ag, Pd, Pt, Al, Ni or Cu. The SiC particles of the voltage-nonlinear resistor 2 further contain at least one of Al (aluminum) and B (boron).

The varistor 1 having such a configuration may be produced by the following steps.

(1) Compounding

Al and B are added to n-type semiconductive β-SiC particles which were doped with 4,100 ppm of N, according to the formulation shown in Table 1. The mixture and an organic solvent were wet-mixed to form a slurry. In Table 1, asterisked Samples 1 and 10 were conventional samples which were prepared for comparison with those of the present invention.

TABLE 1

| Sample | SiC Content (parts by weight) | Al Content (parts by weight) | B Content (parts by weight) | $\epsilon_r$ | α | Varistor Voltage (V/mm) |
|---|---|---|---|---|---|---|
| 1* | 100 | 0 | 0 | 3.40 | 1.8 | 3,900 |
| 2 | 100 | 0.01 | 0 | 3.51 | 18.1 | 2,980 |
| 3 | 100 | 0.5 | 0 | 3.51 | 32.0 | 1,812 |
| 4 | 100 | 5 | 0 | 3.20 | 62.9 | 1,489 |
| 5 | 100 | 10 | 0 | 3.00 | 76.6 | 1,526 |
| 6 | 100 | 20 | 0 | 3.65 | 53.4 | 1,623 |
| 7 | 100 | 30 | 0 | 3.80 | 38.4 | 1,920 |
| 8 | 100 | 50 | 0 | 4.12 | 30.1 | 2,520 |
| 9 | 100 | 100 | 0 | 4.50 | 18.0 | 3,200 |
| 10* | 100 | 0 | 0 | 3.21 | 2.1 | 4,502 |
| 11 | 100 | 0 | 0.01 | 3.42 | 16.5 | 3,200 |
| 12 | 100 | 0 | 0.5 | 3.62 | 22.6 | 1,990 |
| 13 | 100 | 0 | 5 | 3.80 | 23.8 | 1,830 |
| 14 | 100 | 0 | 10 | 3.01 | 25.9 | 2,026 |
| 15 | 100 | 0 | 20 | 3.05 | 30.5 | 2,472 |
| 16 | 100 | 0 | 30 | 3.80 | 32.0 | 2,305 |
| 17 | 100 | 0 | 50 | 4.60 | 25.0 | 2,458 |
| 18 | 100 | 0 | 100 | 4.32 | 14.8 | 3,500 |

(2) Oxidation

The slurry was dried to remove the organic solvent and the solid was heated at 1,500° C. for 2 hours in an oxidizing atmosphere (air). The surfaces of the SiC particles doped with the dopant were oxidized so that Al and B were coordinated on the surfaces of the SiC particles and were partially dissolved into these surfaces.

(3) Preparation of Voltage-nonlinear Resistor Powder

The oxidized particles were sized to prepare a voltage-nonlinear resistor powder.

(4) Wet Compaction Molding

The voltage-nonlinear resistor powder was wet-mixed with an organic binder to form a slurry. The slurry was poured into a metal mold and was compressed under a pressure of 3,000 kgf/cm$^2$ to form a green planar compact.

(5) Thermal Curing

The green planar compact was cured at 100° C. to 200° C.

(6) Shaping

The cured planar compact was cut into a predetermined size and the cut sample was finished by barrel polishing to form the voltage-nonlinear resistor 2 having the shape shown in FIG. 1.

(7) Application of Varistor Electrode Material

A conductive paste composed of Ag or the like was applied to the upper and lower surfaces of the voltage-nonlinear resistor 2 to form the varistor electrodes 3 and 4. The varistor 1 was thereby prepared.

Characteristics of the varistor 1 were evaluated as follows.

The inter-electrode voltage of the varistor 1 was measured while a 0.1-mA DC current was applied and was defined as the varistor voltage $V_{0.1mA}$. The voltage-nonlinearity coefficient a as an index exhibiting the performance of the varistor 1 was calculated from the equation:

$$\alpha=1/\log(V_{0.1mA}/V_{0.01mA})$$

wherein $V_{0.01mA}$ was the varistor voltage when a 0.01 mA DC current was applied.

The apparent relative dielectric constant was calculated from the equation:

$$\epsilon_r=C\times d/(\epsilon_0 S)$$

wherein $\epsilon_0$: the dielectric constant in vacuum,

C: the electrostatic capacitance at 1 MHZ,

S: the electrode area of the varistor, and d: the distance between the varistor electrodes.

These results are shown in Table 1. As shown in Table 1, the varistors having the total contents of Al and B in a range of about 0.01 to 100 parts by weight with respect to 100 parts by weight of SiC (Samples 2 to 9 and 11 to 18) show significantly higher voltage nonlinearity coefficients a than those of the conventional SiC-based varistors (Samples 1 and 10). In particular, the varistors having the total content of Al and B in a range of about 0.5 to 50 parts by weight with respect to 100 parts by weight of SiC (Samples 3 to 8 and 12 to 17) show extremely high voltage nonlinearity coefficients a and low varistor voltages. As a result, the apparent relative dielectric constants of these SiC-based varistors are two orders of magnitude smaller than those of ZnO-based varistors, and the voltage nonlinearity coefficients α thereof are comparable to those of the ZnO-based varistors.

Second Embodiment

Voltage-nonlinear resistors 2 primarily composed of SiC particles, which were doped with N (nitrogen) or P (phosphorus), were prepared. The SiC particles exhibit n-type semiconductive properties. As shown in Table 2, ten batches of particulate SiC having different N and P contents were prepared. After 10 percent by weight of Al (aluminum) was added to each particulate SiC batch, a varistor 1 was produced and the properties thereof were evaluated, as in the first embodiment. Table 2 shows the results.

TABLE 2

| Sample | Dopant | Dopant Content (ppm) | $\epsilon_r$ | α | Varistor Voltage (V/mm) |
|---|---|---|---|---|---|
| 19 | N | 10,080 | 3.65 | 53.4 | 1,442 |
| 20 | N | 4,100 | 3.51 | 40.0 | 1,489 |
| 21 | N | 550 | 3.20 | 62.9 | 1,789 |

TABLE 2-continued

| Sample | Dopant | Dopant Content (ppm) | $\epsilon_r$ | α | Varistor Voltage (V/mm) |
|---|---|---|---|---|---|
| 22 | N | 30 | 3.00 | 76.6 | 1,826 |
| 23* | N | 25 | 3.51 | 1.8 | — |
| 24 | P | 9,450 | 3.80 | 38.4 | 1,350 |
| 25 | P | 3,500 | 3.82 | 43.8 | 1,773 |
| 26 | P | 610 | 3.67 | 50.1 | 1,612 |
| 27 | P | 38 | 3.77 | 49.3 | 1,912 |
| 28* | P | 17 | 5.94 | 2.3 | — |

As shown in Table 2, when the concentration of the dopant, e.g., N or P, is less than about 30 ppm (asterisked Samples 23 and 28), the resistance of the SiC particles is high. As a result, the voltage-nonlinearity coefficient a becomes higher than the upper limit of the measurement of the apparatus. In Sample 21 with an N content of 550 ppm, the voltage-nonlinearity coefficient α exceeds 50, illustrating satisfactory voltage nonlinearity. In Sample 20 with an N content of 4,100 ppm, the voltage-nonlinearity coefficient α is 40. In view of these results, the concentration of the N or P dopant in SiC is in a range of preferably about 30 ppm to 10,000 ppm, and more preferably about 300 ppm to 5,000 ppm.

Third Embodiment

Using α-SiC particles and β-SiC particles, voltage-nonlinear resistors 2 were prepared as in the first embodiment in which the N content was 500 ppm and the Al content was 10 percent by weight, and varistor electrodes 3 and 4 were formed on each voltage-nonlinear resistor 2 to evaluate the varistor characteristics. Herein, the α-SiC particles are polymorphic and consist of zincblende layers and wurtzite layers, whereas the β-SiC particles have a zincblende structure. The results are shown in Table 3.

TABLE 3

| Sample | SiC Crystal System | Nitrogen Content (ppm) | $\epsilon_r$ | α | Varistor Voltage (V/mm) |
|---|---|---|---|---|---|
| 29 | α-SiC | 480 | 3.42 | 26.6 | 2,100 |
| 30 | β-SiC | 550 | 3.61 | 42.5 | 1,730 |

SiC has different electrical characteristics, particularly in electron mobility and saturated electron drift mobility, depending on the crystal systems thereof. β-SiC particles exhibit higher electron mobility and saturated electron drift mobility compared to α-SiC particles. Thus, the β-SiC particles exhibit lower internal resistance and are suitable for use in a large current flow. Accordingly, use of the β-SiC particles is preferred in the present invention.

Fourth Embodiment

Two types of voltage-nonlinear resistor powders were prepared, while the heat treatment temperature in the SiC oxidation step was varied in a range of 800° C. to 1,600° C. Other conditions and the production process were the same as those in the first embodiment. The first type contained 10 percent by weight of Al (aluminum) and the second type contained 10 percent by weight of B (boron).

Figure 2:
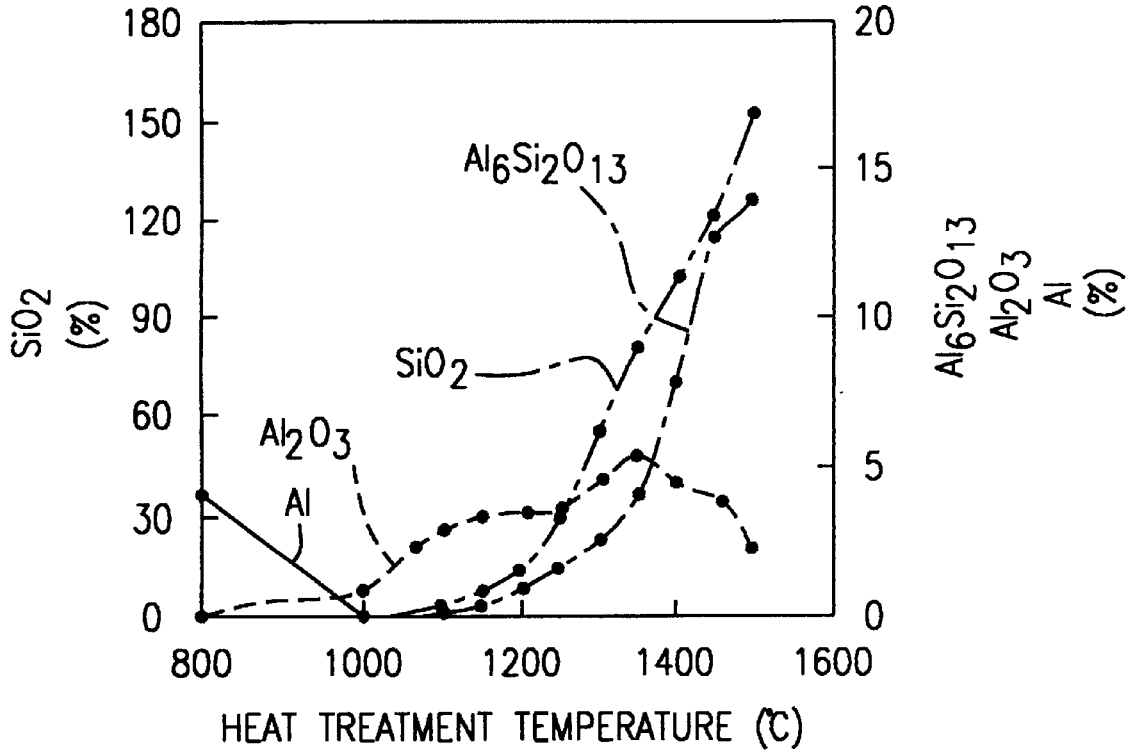
FIG. 2 is a graph showing the relationship between the yield of the products including oxides and the heat treatment temperature.

FIG. 2 is a graph of the dependence of yields of products including oxides on the heat treatment temperature in the voltage-nonlinear resistor powder containing 10 percent by weight of Al. The yields were determined by X-ray diffraction intensities of the corresponding products, and the ordinate represents $SiO_2$, $Al_6Si_2O_{13}$, $Al_2O_3$ and Al contents, which were calculated from the corresponding X-ray diffraction intensities on a basis of the intensity of SiC.

FIG. 2 suggests that $SiO_2$ forms by surface oxidation of SiC in a temperature range of 1,000° C. to 1,050° C. At a temperature above 1,050° C., a fraction of $SiO_2$ reacts with $Al_2O_3$ to form $3Al_2O_3.2SiO_2$ (mullite). When boron is added, borosilicate is formed by the reaction with $SiO_2$. The yield of the mullite tends to increase as the heat treatment temperature increases. Due to the formation of the mullite by the reaction of $SiO_2$ with $Al_2O_3$, the diffractive intensity of $Al_2O_3$ decreases at the high-temperature side.

Figure 3:
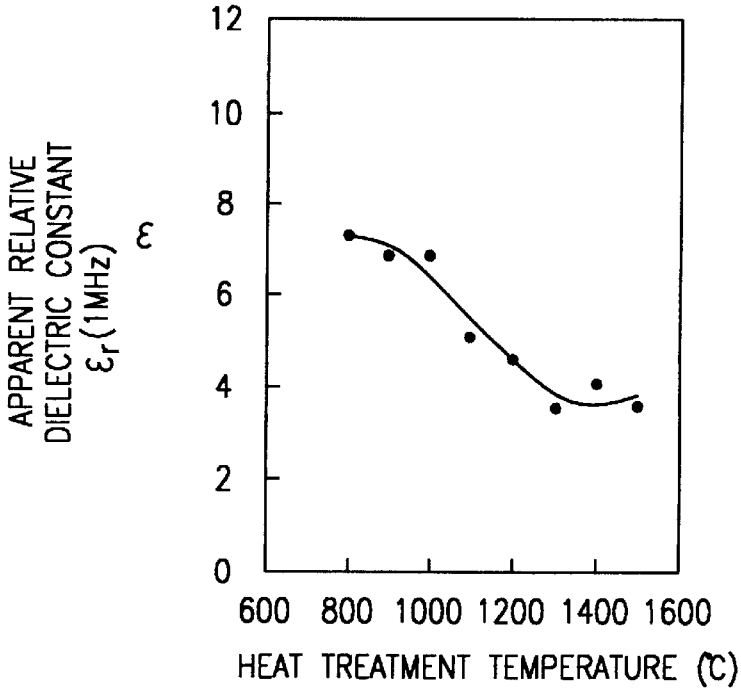
FIG. 3 is a graph showing the relationship between the apparent relative dielectric constant and the heat treatment temperature.
Figure 4:
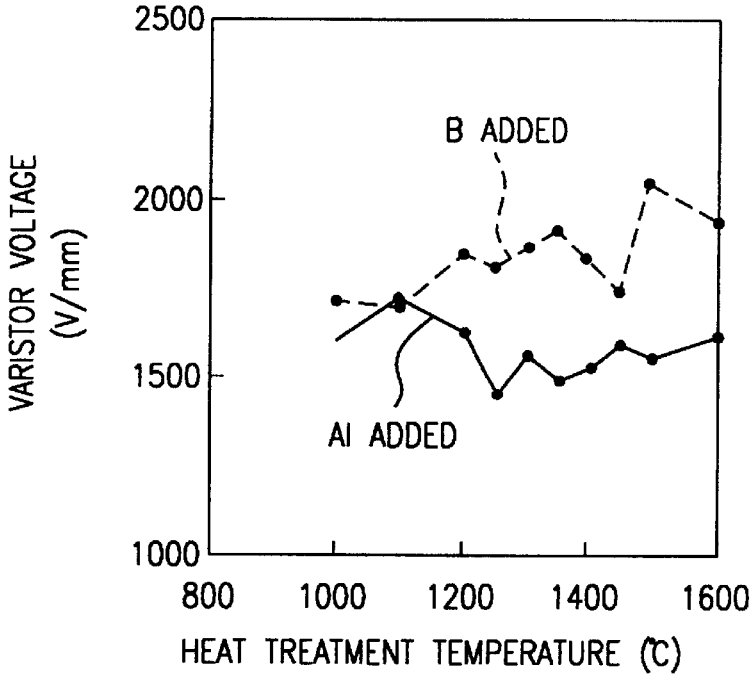
FIG. 4 is a graph showing the relationship between the varistor voltage and the heat treatment temperature.
Figure 5:
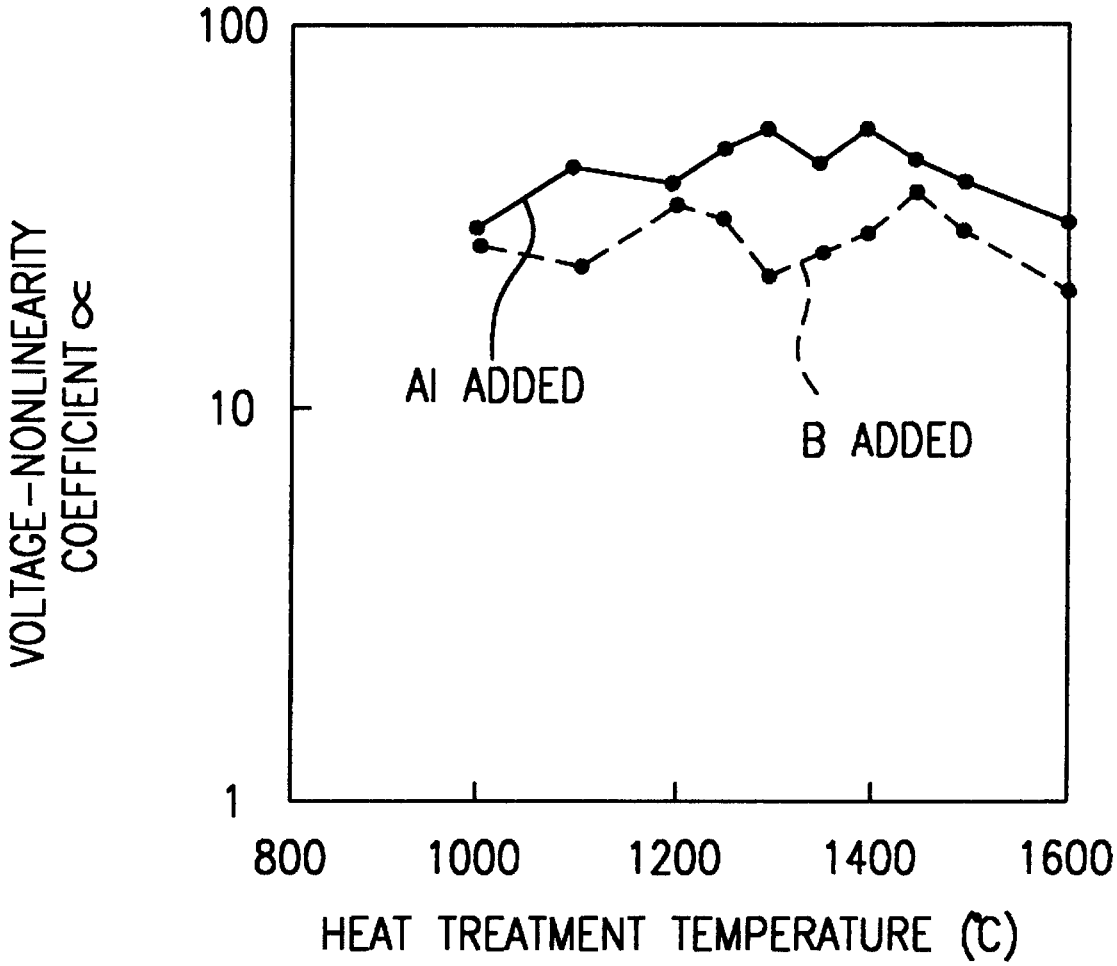
FIG. 5 is a graph showing the relationship between the voltage-nonlinearity coefficient a and the heat treatment temperature.

Using the voltage-nonlinear resistor powders heat-treated at various temperatures, voltage-nonlinear resistors 2 shown in FIG. 1 were produced, and varistor electrodes 3 and 4 were formed on each voltage-nonlinear resistor 2 to evaluate varistor characteristics. The results are shown in FIGS. 3 to 5. As shown in FIGS. 3 to 5, the varistor 1 heat-treated at about 1,000° C. to 1,600° C. exhibits a small electrostatic capacitance, a high voltage-nonlinearity coefficient α and a low varistor voltage. In the heat treatment at a temperature below 1,000° C., the voltage-nonlinear resistor 2 exhibits significantly high resistance and the varistor characteristics cannot be measured. Accordingly, the preferable heat treatment temperature is in a range of about 1,000° C. to 1,600° C.

Fifth Embodiment

Varistor electrodes 3 and 4 composed of materials shown in Table 4 were formed on voltage-nonlinear resistors 2 prepared as in the first embodiment to prepare seven varistors. The results are shown in Table 4.

TABLE 4

| Sample | Electrode Material | $\epsilon_r$ | α | Varistor Voltage (V/mm) |
|---|---|---|---|---|
| 31 | Ag | 3.68 | 60 | 1,730 |
| 32 | Pd | 4.02 | 61 | 1,620 |
| 33 | Pt | 3.45 | 54 | 1,830 |
| 34 | Al | 3.88 | 66 | 1,403 |
| 35 | Ni | 4.51 | 42 | 1,320 |
| 36 | Cu | 4.23 | 48 | 1,550 |
| 37 | In—Ga | 4.80 | 43 | 1,420 |

As shown in Table 4, each varistor 1 exhibits a low electrostatic capacitance, a high voltage-nonlinearity coefficient a and a low varistor voltage in all materials for the varistor electrodes 3 and 4. The results suggest that the varistor characteristics of the voltage-nonlinear resistor 2 in the present invention are not derived from the Schottky contact barrier at the interface between the SiC and the varistor electrode metal, but are derived from SiC grain boundaries. Moreover, these grains boundaries exhibit low electrostatic capacitance and a high voltage-nonlinearity coefficent α. Thus, any material can be employed as a varistor electrode material depending on the intended use and the use of a base metal contributes to reducing material costs.

The voltage-nonlinear resistor of the present invention, the method for making the same and the varistor using the voltage-nonlinear resistor are not limited to the above embodiments, and any modification is possible within the scope of the present invention.

What is claimed is:

1. A voltage-nonlinear resistor comprising doped SiC particles containing at least one of elemental Al and B, wherein surfaces of the doped SiC particles are oxidized.

2. The voltage-nonlinear resistor according to claim 1, wherein the at least one of elemental Al and B is coordinated on the surfaces of the doped SiC particles.

3. A varistor comprising a voltage-nonlinear resistor according to claim 2 in combination with varistor electrodes.

4. A varistor according to claim 3, wherein the varistor electrodes comprise at least one metal selected from the group consisting of Ag, Pd, Pt, Al, Ni and Cu.

5. The voltage-nonlinear resistor according to claim 1, wherein the total content of Al and B is in a range of about 0.01 to 100 parts by weight with respect to 100 parts by weight of the doped SiC particles.

6. The voltage-nonlinear resistor according to claim 5, wherein the total content of Al and B is in a range of about 0.5 to 50 parts by weight with respect to 100 parts by weight of the doped SiC particles.

7. The voltage-nonlinear resistor according to claim 6, wherein the dopant is at least one of elemental N and P.

8. The voltage-nonlinear resistor according to claim 7, wherein the total content of the dopant is in a range of about 30 to 10,000 ppm.

9. The voltage-nonlinear resistor according to claim 7, wherein the total content of the dopant is in a range of about 300 to 500 ppm.

10. The voltage-nonlinear resistor according to claim 7, wherein the doped SiC is an n-type semiconductor.

11. The voltage-nonlinear resistor according to claim 10, wherein the SiC has a β-type crystal system.

12. A varistor comprising a voltage-nonlinear resistor according to claim 11 in combination with varistor electrodes.

13. A varistor according to claim 12, wherein the varistor electrodes comprise at least one metal selected from the group consisting of Ag, Pd, Pt, Al, Ni and Cu.

14. The voltage-nonlinear resistor according to claim 1, wherein the total content of Al and B is in a range of about 0.01 to 100 parts by weight with respect to 100 parts by weight of the doped SiC particles and the total content of the dopant is in a range of about 30 to 10,000 ppm.

15. The voltage-nonlinear resistor according to claim 1, wherein the SiC has a β-type crystal system.

16. A varistor comprising a voltage-nonlinear resistor according to claim 1 in combination with varistor electrodes.

17. A varistor according to claim 16, wherein the varistor electrodes comprise at least one metal selected from the group consisting of Ag, Pd, Pt, Al, Ni and Cu.

* * * * *